US011433670B2

(12) United States Patent
Cumbie et al.

(10) Patent No.: US 11,433,670 B2
(45) Date of Patent: Sep. 6, 2022

(54) CONDUCTIVE ELEMENTS ELECTRICALLY COUPLED TO FLUIDIC DIES

(71) Applicant: Hewlett-Packard Development Company, L.P., Spring, TX (US)

(72) Inventors: Michael W Cumbie, Albany, OR (US); Chien-Hua Chen, Corvallis, OR (US); Randy Hoffman, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/958,607

(22) PCT Filed: Apr. 29, 2019

(86) PCT No.: PCT/US2019/029716
§ 371 (c)(1),
(2) Date: Jun. 26, 2020

(87) PCT Pub. No.: WO2020/222767
PCT Pub. Date: Nov. 5, 2020

(65) Prior Publication Data

US 2021/0252858 A1 Aug. 19, 2021

(51) Int. Cl.
*B41J 2/14* (2006.01)
*B41J 2/16* (2006.01)

(52) U.S. Cl.
CPC ..... *B41J 2/1433* (2013.01); *B41J 2/162* (2013.01); *B41J 2/1623* (2013.01); *B41J 2002/14491* (2013.01)

(58) Field of Classification Search
CPC ..... B41J 2/1433; B41J 2/162; B41J 2/1623
See application file for complete search history.

(56) References Cited

U.S. PATENT DOCUMENTS

| | | | | |
|---|---|---|---|---|
| 5,858,190 | A | 1/1999 | Hayes | |
| 6,234,598 | B1 * | 5/2001 | Torgerson | B41J 2/04533 347/13 |
| 7,454,836 | B2 * | 11/2008 | Furuya | B41J 2/161 29/25.35 |
| 7,622,048 | B2 | 11/2009 | Birkmeyer et al. | |
| 8,439,494 | B2 | 5/2013 | Owaki et al. | |
| 8,491,087 | B2 | 7/2013 | Sakai et al. | |
| 9,707,758 | B2 | 7/2017 | Anderson et al. | |
| 2007/0214621 | A1 | 9/2007 | Furuya | |
| 2012/0167823 | A1 * | 7/2012 | Gardner | H01L 41/0805 118/695 |

(Continued)

FOREIGN PATENT DOCUMENTS

| | | | |
|---|---|---|---|
| CN | 108367568 | A | 8/2018 |
| EP | 3421242 | A1 | 1/2019 |

(Continued)

*Primary Examiner* — Jason S Uhlenhake
(74) *Attorney, Agent, or Firm* — Austin Rapp

(57) ABSTRACT

An example fluidic device may comprise a fluidic die and a support element coupled to the fluidic die. A fluid channel may be arranged within the support element and may define a fluid path through the support element and a fluid aperture of the fluidic die. A conductive element may be arranged in the fluid path and be coupled to a ground of the fluidic die. A material and size of the conductive element may be selected to engender galvanic effect at an approximately zero potential.

15 Claims, 5 Drawing Sheets

(56) References Cited

U.S. PATENT DOCUMENTS

| | | | |
|---|---|---|---|
| 2014/0132674 | A1 | 5/2014 | Takeuchi et al. |
| 2017/0087842 | A1 | 3/2017 | Koide |

FOREIGN PATENT DOCUMENTS

| | | |
|---|---|---|
| JP | 2001162803 | 6/2001 |
| JP | 2008188793 | 8/2008 |
| WO | WO-1986005722 | 10/1986 |
| WO | WO-2019050540 | 3/2019 |

* cited by examiner

CONDUCTIVE ELEMENTS ELECTRICALLY COUPLED TO FLUIDIC DIES

BACKGROUND

Fluidic devices refer to devices capable of discharging fluids, such as via a nozzle of a fluidic die. Fluidic devices may be used in printing devices, by way of non-limiting example, to form markings on a substrate or build material. Fluid may traverse a fluid path within the fluidic devices, including via a fluid port, a fluid chamber, and nozzles of a fluidic die. Fluids may contain electrolytes and/or may have a pH value of 7 or more.

BRIEF DESCRIPTION OF THE DRAWINGS

Various examples will be described below by referring to the following figures.

Figure 1A:
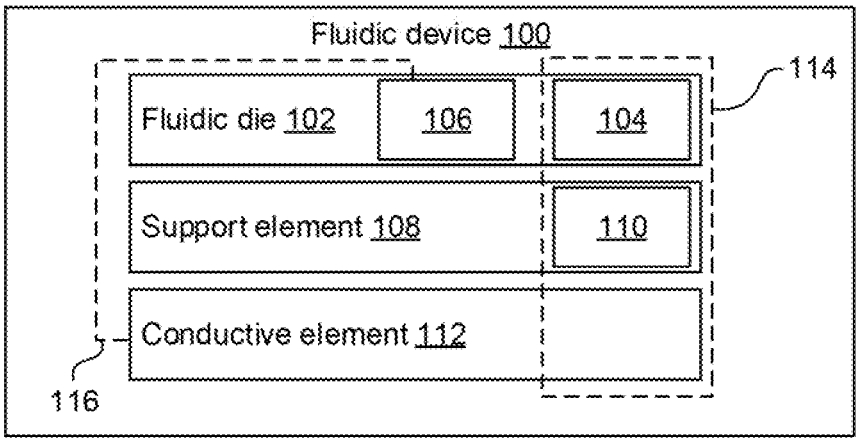
FIGS. 1A and 1B are block diagrams illustrating example fluidic devices.

Reference is made in the following detailed description to accompanying drawings, which form a part hereof, wherein like numerals may designate like parts throughout that are corresponding and/or analogous. It will be appreciated that the figures have not necessarily been drawn to scale, such as for simplicity and/or clarity of illustration.

DETAILED DESCRIPTION

Fluid ejection devices may be used for a number of purposes, such as ejecting marking fluids onto a substrate to form text and images, ejecting colorants and additives onto a bed of additive materials, and microfluidic-based biomedical applications, by way of non-limiting example. At times, portions of a fluid flow path may include materials that may be responsive and/or sensitive to flowing fluids. For example, some materials within a fluid flow path may be susceptible to etching by fluids. Taking the example of an inkjet or bubblejet fluidic device comprising a silicon-based fluidic die for ejecting marking fluids, portions of the silicon within the fluidic device may react to contacted fluids (e.g., due to pH levels of the fluids); for instance contacted fluids may etch portions of the silicon.

Continuing with the example of an example inkjet fluidic device, some fluids may etch away at the silicon of feed holes through which the fluids are to be expelled. Existing methods of protecting a silicon die against etching may introduce complexity and/or cost in the manufacturing process. For example, etching may potentially be reduced and/or avoided through application of a protective layer to susceptible components and/or changes to marking fluid compositions (e.g., reducing amounts of pigments). Applying a protective layer to the silicon of the fluidic device using deposition techniques (e.g., sputtering) may be expensive both in terms of materials and in manufacturing complexity and cost. And growing a protective layer through the application of a voltage potential bias can cause the fluids (e.g., marking fluids) to break down. Further, changing marking fluid compositions can lead to reduced print quality, by way of example. Of course, while the foregoing examples are presented in terms of an inkjet fluidic device, it is noted the following discussion applies equally to other fluidic devices.

In view of the foregoing, it should be appreciated that there may be a desire for an approach (e.g., a combination of components and/or materials) to reduce undesirable material etching. In some cases, it may be possible to avoid undesirable material etch using an arrangement of components to take advantage of a galvanic effect, such as to form a protective layer at a zero potential. For instance, in one case, a conductive element may be arranged in the fluid path of a fluidic device. The conductive element may be grounded together with the fluidic die of the fluidic device. The material and the size of the conductive element may be selected to engender galvanic effect at an approximately zero potential, such as in response to contact with an electrolyte (e.g., a marking agent).

Turning to FIG. 1A, an implementation of a device for avoiding and/or reducing undesirable material etch is illustrated as a schematic diagram. FIG. 1A shows an example fluidic device 100 comprising a fluidic die 102, a support element 108, and a conductive element 112. Fluidic device 100 may comprise a device capable of ejecting fluids, such as discussed above. Example fluidic devices, such as fluidic device 100, may include inkjet or bubblejet ejection devices or piezo-based ejection devices by way of non-limiting example. Fluidic device 100 may be implemented in printing devices, such as two-dimensional (2D) printers and/or three-dimensional (3D) printers. As should be appreciated, some example fluidic devices may include printheads. In some examples, a fluidic device may be implemented into a printing device and may be utilized to print content onto a media, such as paper, a layer of powder-based build material, reactive devices (such as lab-on-a-chip devices), etc. Example fluidic devices include ink-based ejection devices, digital titration devices, 3D printing devices, pharmaceutical dispensation devices, lab-on-chip devices, fluidic diagnostic circuits, and/or other such devices in which amounts of fluids may be dispensed or ejected.

In some examples, a printing device in which a fluid ejection device may be implemented may print content by deposition of consumable fluids in a layer-wise additive manufacturing process. Consumable fluids and/or consumable materials may include all materials and/or compounds used, including, for example, ink, toner, fluids or powders (e.g., agents and colorants), or other raw material for printing. Furthermore, printing material, as described herein may comprise consumable fluids as well as other consumable materials. Printing material may comprise ink, toner, fluids, powders, colorants, varnishes, finishes, gloss enhancers, binders, fusing agents, inhibiting agents, and/or other such materials that may be utilized in a printing process.

Fluidic dies, such as fluidic die 102 may correspond to a fluid ejection die. For instance, fluidic die 102 may comprise a plurality of nozzles, which the nozzles may be used to selectively dispense drops of fluid (e.g., of marking fluid or build agents) via the nozzles. Fluidic die 102 may comprise a number of surfaces, such as a top surface and a lower surface. The top surface of fluidic die 102 may include nozzle orifices formed therein. A nozzle layer of fluidic die 102 may include nozzles formed the through and terminating at the nozzle orifices on the top surface. The nozzles of a fluid ejection die, such as fluidic die 102, may be fluidically coupled to a fluid chamber, which may be formed in a chamber layer of fluidic die 102 that is adjacent to the nozzle layer. A fluid actuator may be disposed in (or in proximity to) the fluid chambers, and actuation of respective fluid actuators may cause ejection of a fluid drop through a corresponding nozzle fluidically coupled to the fluid chamber. Fluid may travel via fluid ports in a lower surface of fluidic die 102, through the fluid chamber, and out through the nozzles. For simplicity, the term fluid aperture 104 is used to refer to an opening or path through fluidic die 102 and may comprise a fluid port, a fluid chamber, and a nozzle, without limitation.

Some examples fluid actuators implemented in fluidic devices include thermal ejectors, piezoelectric ejectors, and/or other such ejectors that may cause fluid drops to eject and/or dispensed from a nozzle orifice. In some examples, fluidic dies may be formed with silicon or a silicon-based material. Various features, such as nozzles, fluid chambers, and fluid passages may be formed from various materials and processes used in silicon device-based fabrication, such as silicon, silicon dioxide, silicon nitride, metals, epoxy, polyimide, other carbon-based materials, etc. Where such fluidic features may be formed by various microfabrication processes, such as etching, deposition, photolithography, bonding, cutting, and/or other such microfabrication processes.

In some examples, fluidic dies may be referred to as slivers. Generally, a sliver may correspond to a fluidic die having: a thickness of approximately 650 μm or less; exterior dimensions of approximately 30 mm or less; and/or a length to width ratio of approximately 3 to 1 or larger. In some examples, a length to width ratio of a sliver may be approximately 10 to 1 or larger. In some examples, a length to width ratio of a sliver may be approximately 50 to 1 or larger. It should be appreciated that as a size of a fluidic die decreases to the range of a sliver, the effects of fluid etch may become more pronounced. For at least this reason, there may be a desire for an approach of avoiding and/or reducing undesirable material etch, such as etch of a fluidic die.

In some examples, fluidic dies may be a non-rectangular shape. In these examples a first portion of the fluidic die may have dimensions/features approximating the examples described above, and a second portion of the fluidic die may be greater in width and less in length than the first portion. In some examples, a width of the second portion may be approximately 2 times the size of the width of the first portion. In these examples, a fluidic die may have an elongate first portion along which nozzles may be arranged, and the fluid ejection die may have a second portion upon which electrical connection points for the fluidic die may be arranged.

Fluidic die 102 may also include a ground 106, which refers to a point of connection, such as in the form of an electrode, that may be electrically coupled to a ground for fluidic device 100.

Support element 108 refers to an element to which fluidic die 102 may be secured, either directly or indirectly, such as via an adhesive. Support element 108 may comprise an epoxy mold compound, and fluidic die 102 may be molded (in whole or in part) within support element 108.

In some examples, support element 108 may be formed of a single material (e.g., the support element may be uniform). Furthermore, in some examples, support element 108 may be a single piece (e.g., the support element may be monolithic). In some examples, support element 108 (and/or a chiclet, as shall be discussed further hereinafter) may comprise an epoxy mold compound, such as CEL400ZHF40WG from Hitachi Chemical, Inc., and/or other such materials. In another example, support element 108 and/or chiclet may comprise thermal plastic materials such as PET, PPS, LCP, PSU, PEEK, and/or other such materials. Accordingly, in some examples, support element 108 and/or chiclet may be substantially uniform. In some examples, support element 108 and/or chiclet may be formed of a single piece, such that the support element and/or chiclet may comprise a mold material without joints or seams. As used herein, a molded support element and/or molded chiclet may not refer to a process in which the carrier and/or chiclet may be formed; rather, a molded support element and/or molded chiclet may refer to the material from which the carrier and/or chiclet may be formed, without limitation.

Support element 108 may include a fluid channel 110, which may correspond to a lower surface of fluidic die 102 and a fluid port of fluid aperture 104 of fluidic die 102. The combination of fluid channel 110 and fluid aperture 104 may form a fluid path 114. As noted above, fluid within and/or traveling through fluid path 114 may etch away materials exposed to the fluid within fluid path 114. Therefore, there may be a desire for a structure usable to reduce and/or eliminate undesirable material etch within fluid path 114.

In one implementation, conductive element 112 may be arranged within fluid path 114 to expose a surface (in whole or in part) to fluid within and/or traveling fluid path 114. Conductive element 112 may be electrically coupled to a ground 106 of fluidic die 102, such as via an electrical coupling illustrated by dotted line 116. In one example, for instance, conductive element 112 and ground 106 of fluidic the 102 may be electrically coupled to a common ground (e.g., of fluidic device 100). Conductive element 112 may comprise a number of metals and/or metalloids, including, but not limited to, metal- and/or metalloid-based plating. Example materials for conductive element 112 include, but are not limited to, gold (Au), tantalum (Ta), platinum (Pt), palladium (Pd), and nickel (Ni), by way of illustration. In one example, for instance, it may be determined that for a silicon-based fluidic die, conductive element 112 comprising gold may be capable of reducing and/or eliminating etch of the silicon-based fluidic die. This may be due to a relationship between materials, such as may be indicative by reference to classification of materials within a galvanic series, corresponding levels of electrochemical voltage developed between the metals (e.g., as may be indicated by the anodic index), etc. Another factor in the selection of materials may include the respective exposed surface area of conductive element (e.g., conductive element 112) and exposed surface area of the fluidic die (e.g., fluidic die 102). For example, in some cases, the ratio of exposed surface area of the conductive element to exposed surface area of the fluidic die may be 3:1. In other examples, the ratio may be 2:1. In yet other examples, the ratio may be 1:1. Additionally, the ratios may not be restricted to whole numbers. Indeed, ratios of 2.5:1 and 3.5:1 may be used in some cases, such as due to selected materials and fluids. Etc.

It is noted that conductive element 112 is illustrated such that a portion thereof is partially within fluid path 114. This is done to illustrate that a portion of conductive element 112 is arranged within fluid path 114. This is done without limitation because, of course, in some cases, the entirety of conductive element 112 may be arranged within fluid path 114.

In operation, a fluidic device (e.g., fluidic device 100) may include a fluidic die (e.g., fluidic die 102) and a support element (e.g., support element 108) coupled to the fluidic die. A fluid channel (e.g., fluid channel 110) may be arranged within the support element and may define a fluid path (e.g., fluid path 114) through the support element and a fluid aperture (e.g., fluid aperture 104) of the fluidic die. The fluidic device may also include a conductive element (e.g., conductive element 112) arranged in the fluid path. The conductive element may be electrically coupled (e.g., as illustrated by electrical coupling lines 116) to a ground (e.g., ground 106) of the fluidic die. And a material and size of the conductive element is selected to engender galvanic effect at an approximately zero potential. By way of example, the conductive element may include gold (Au). As such, the fluidic die and the conductive element are to form an electrochemical cell while in contact with an electrolyte (e.g., a marking fluid). For instance, due (in part or in whole) to the materials of the fluidic die and the conductive element, a protective layer may be grown on a portion (if not all) of the fluid paths in response to application of a zero external potential (e.g., due to the galvanic effect between the grounded conductive member 112 and the fluidic die 102 on the one hand, and the fluid in the fluid path acting as an electrolyte). For example, an oxide layer may be formed, such as using ions from one of the materials (e.g., in response to a contact between the electrolyte with the conductive element and the fluidic die).

Consequently, the fluidic die (e.g., fluidic die 102) may be protected against etch by fluid in the fluid path.

Figure 1B:
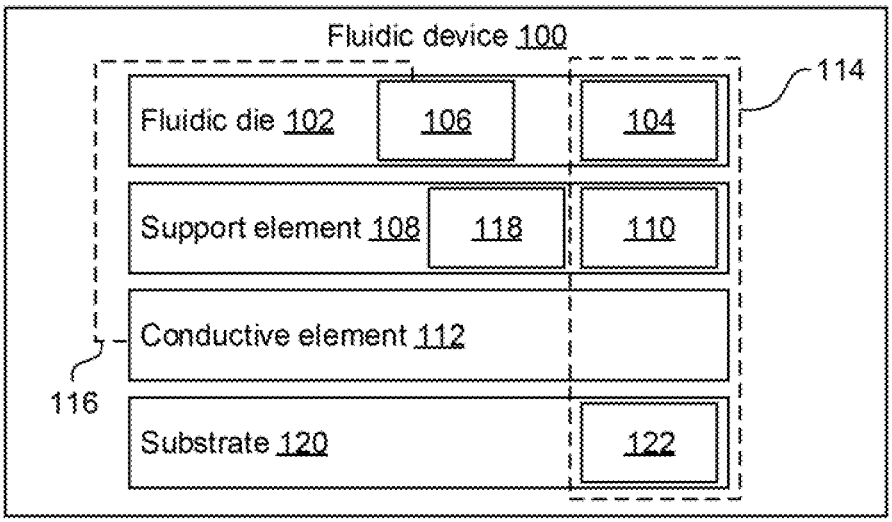

FIG. 1B illustrates a further example device, such as for mitigating unwanted material etch of fluidic die 102. Similar to FIG. 1A, FIG. 1B illustrates a fluidic device 100 having a fluidic die 102, a support element 108, and a conductive element 112. Also, similar to the implementation of FIG. 1A, fluidic die 102 includes a ground 106 and a fluid aperture 104; and support element has a fluid channel 110. Additionally, conductive element 112 is illustrated as electrically coupled to a common ground with ground 106 of fluidic die 102. Hereinafter, reference to preceding elements, such as those of FIG. 1B, will be made to not similar function and/or structure, but this is not to be taken in a limiting sense. Indeed, in some cases, the components of a particular implementation may vary slightly as compared with other implementations. Returning to the implementation of FIG. 1B, it also illustrates embedded conductive leads 118. Embedded conductive leads 118 may take the form of conductive leads formed (e.g., molded, deposited, etc.) within support element 108, such as to enable the electrical coupling illustrated by dotted line 116. In one case, for example, embedded conductive leads 118 may be part of a lead frame within a molded epoxy structure, without limitation.

Fluidic device 100 of FIG. 1B also includes a substrate 120. Substrate 120 may be any structure or device connected to support element capable of providing physical, electrical, and/or fluidic support (among other things) to fluidic device 100. For example, in one case, substrate 120 may comprise a material similar to that used for support element 108 (e.g., an epoxy). Substrate 120 may be alternatively referred to as a "chiclet," as discussed above. In some cases, substrate 120 or the chiclet may serve as a secondary support element. The chiclet may be coupled to support element 108, such as within a recess of support element. In some examples, a chiclet and/or support element may be formed by a molding process. In other examples, a chiclet and/or support element may be formed by an encapsulation process. In other examples, a chiclet and/or support element may be formed by other machining processes, such as cutting, grinding, bonding, etc. Substrate 120 may also comprise a fluid channel 122, such as may correspond to fluid channel 110 of support element 108. Along with fluid channel 110 and fluid aperture 104, fluid channel 122 may define a fluid path.

As shall be discussed further hereinafter (e.g., FIG. 4), in some implementations, substrate 120 may also include embedded conductive leads.

Figure 2:
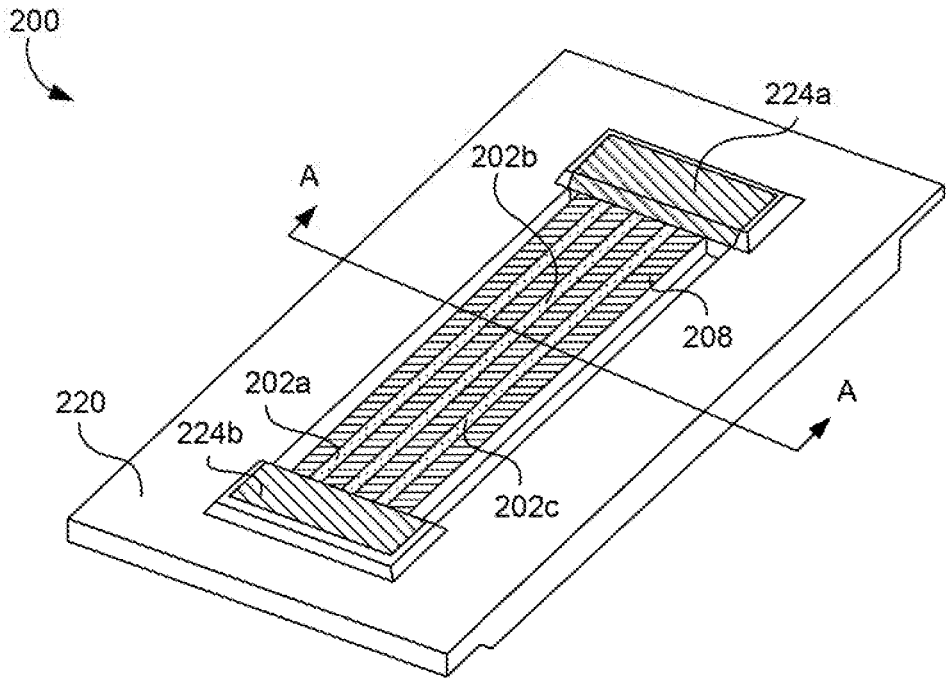
FIG. 2 is a perspective view of an example fluidic device.

Turning next to FIG. 2, it is a perspective view of an example fluidic device 200 comprising fluidic dies 202*a*-202*c* arranged within fluid channels (obscured by fluidic dies 202*a*-202*c*) within support element 208. In addition to support element 208, fluidic device 200 may also include a substrate 220, as discussed above. Encaps 224*a* and 224*b* are illustrated and are structures to protect fluidic dies 202*a*-202*c*, such as during cleaning and/or servicing. FIG. 2 also shows cross-section arrows, labeled with an 'A,' to illustrate a perspective for schematic cross-section illustrations, FIGS. 3A-3C.

Figure 3A:
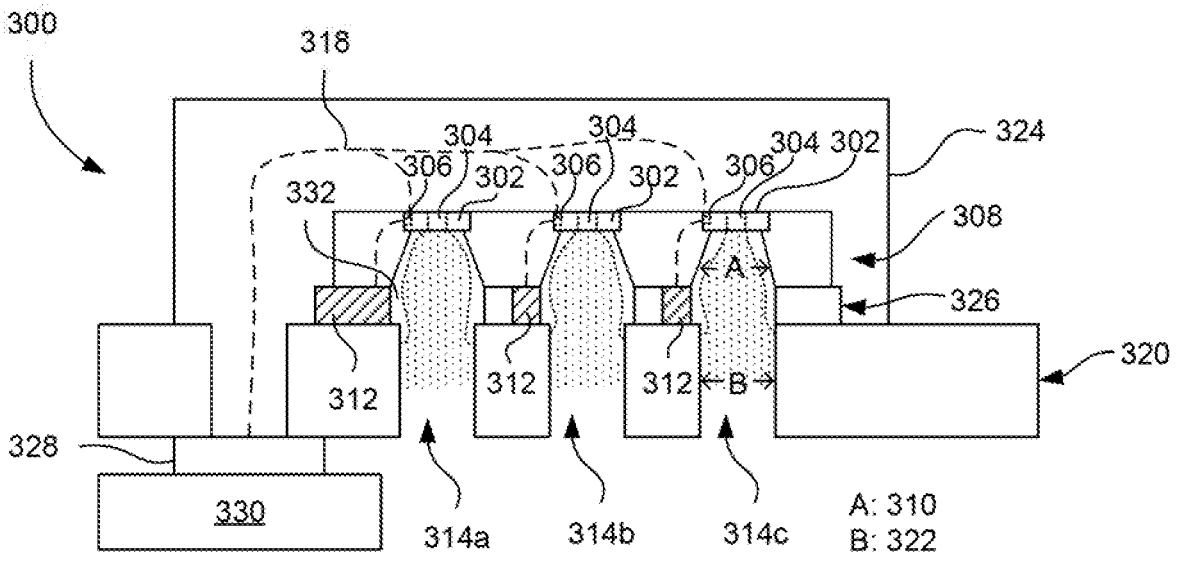
FIGS. 3A-3C are schematic cross-sectional diagrams of example fluidic devices.

Turning to FIG. 3A, a cross-section of an example fluidic device 300 is illustrated as a schematic diagram. It is noted that proportions of elements, sizes, placement of components, etc. is shown in a simplified form in order to simplify review thereof. This is done without limitation and the scope of claimed subject matter extends beyond the narrow illustrative implementations discussed herein.

Example fluidic device 300 is illustrated as having fluidic dies 302, support elements 308, conductive elements 312, a substrate 320, and an encap 324. It is noted that fluidic dies 302, support elements 308, conductive elements 312, substrate 320, and encap 324 may be similar to corresponding components discussed above in relation to FIGS. 1A, 1B, and 2, and thus discussion of their structure and/or function is not repeated here.

Fluidic dies 302 include fluid apertures 304 that are illustrated simply as a through-hole passage. As noted above, the exact structure of fluidic dies 302 may include fluid ports, fluid chambers with actuation members, and nozzles. However, to simplify the discussion, these features are not illustrated in the schematic arrangement of FIGS. 3A-3D. Fluid apertures 304 are illustrated at one extremity of fluid paths 314*a*-314*c*, which fluid paths 314*a*-314*c* are defined by a fluid channel 310 (represented by an A within fluid path 314*c* due to space limitations in the drawing) of support element 308, and a fluid channel 322 (represented by a B within fluid path 314*c*) of substrate 320. Fluidic dies 302 also include ground 306, which is connected to a common ground (e.g., ground 328) of chip package 330. Embedded conductive leads 318 are shown traversing support element 308 and also through encap 324. It is noted that the actual routing thereof may be different, such as also through substrate 320. The illustrated embedded conductive leads 318 are merely used to illustrate an electrical coupling between elements of fluidic device 300.

Additionally, it is noted that support element 308 is labeled with a single arrow and element label, however, it is to be understood that the arrow of support, element 308 is to refer to all four portions of support element 308 which define respective fluid channels 310.

Similarly, substrate 320 is illustrated in five portions and indicated using a single arrow and element label, also to avoid unnecessary repetition of element labels and keep the drawings clear. As should be apparent, portions of substrate define fluid channels 322 similarly to the portions of support element 308. As discussed above, the portions of substrate 320 may act as a secondary support for both support element 308 and fluidic dies 302.

An adhesive 326 is illustrated as a layer between support element 308 and substrate 320. Adhesive 326 may comprise any suitable adhesive compound capable of causing support element 308 and substrate 320 to adhere together. It is noted that the unfilled rectangular portions within the adhesive 326 layer (and adjacent to the two right-most conductive elements 312 also correspond to adhesive 326.

Chip package 330 refers to a structure containing circuit elements that may include by way of non-limiting example, wire traces, discrete and integrated circuit elements, electrodes and other electrical contacts, etc. Examples of chip package 330 may include a printed circuit board (PCB) or an encapsulated lead frame.

Within fluid paths 314*a*-314*c* there is a dotted fill pattern to indicate the potential presence of a fluid, which may include an electrolyte, such as a pigment-based marking agent. The fluid may cause etch of materials within fluid paths 314*a*-314*c*, such as etching away portions of fluidic dies 302. Due (in whole or in part), to a common grounding between conductive elements 312 and ground 306 of fluidic dies, in response to contact between fluid in fluid paths 314*a*-314*c* on the one hand and conductive elements 312 and fluidic dies 302 on the other, a galvanic effect may be engendered. Said otherwise, while a zero potential is applied between the electrically coupled ground 306 and conductive elements 312, in response to contact with an electrolyte, an electrochemical cell may be formed. This may lead to generation of a protective layer (illustrated with a dotted line within fluid paths 314*a*-314*c*). One example portion of such a protective layer is indicated and labeled within fluid path 314*a* and protective layer 332. By way of example, therefore, protective layer 332 may protect a lower surface of fluidic dies 302 from etch.

With the foregoing in mind, in operation, structures, such as the foregoing, may enable reduction or elimination of undesirable fluid material etch. An example fluidic device (e.g., fluidic device 300) may thus include a fluidic die (e.g., fluidic die 302) comprising, a fluid aperture (e.g., fluid aperture 304), a support element (e.g., support element 308) coupled to the fluidic die, and a conductive element (e.g., conductive element 312). The support element may comprise a fluid channel (e.g., fluid channel 310) corresponding to the fluid aperture to define a fluid path (e.g., fluid path 314*c*) through the support element and the fluidic die. The fluidic device may include embedded conductive leads (e.g., embedded conductive leads 318). The conductive element may be arranged with respect to the fluidic die and the support element such that a surface of the conductive element is arranged in the fluid channel. The conductive element may be electrically coupled via the embedded conductive leads to a ground of the fluidic die. As should be apparent from FIG. 3A, the embedded conductive leads 318 may provide an electrical coupling between a ground of a number of fluidic dies (e.g., fluidic dies 302) and a number of conductive elements (e.g., conductive elements 312).

The fluidic device may further include a chip package (e.g., chip package 330), which may include a printed circuit board (PCB), molded interconnect device, or molded lead frame device. The chip package may be coupled to the substrate and include a ground connected to a ground lead of embedded conductive leads.

In one implementation, a ratio of a surface area of the surface of the conductive element arranged in the fluid channel to a surface area of the fluidic die exposed in the fluid path is approximately 1:1 to 3:1. Of course, this particular arrangement may be selected based on particular materials used for fluidic dies and conductive elements, and other ratios and arrangements may be used for other combinations of materials and components, without limitation.

Additionally, in one implementation (and as illustrated in FIG. 3A), the fluidic die and the conductive element may be arranged such that a structural element, an adhesive, a gap, or a combination thereof, provide a physical separation between the fluidic die and the conductive element. Indeed, as illustrated in FIG. 3A, support element 308 and/or adhesive 326 provide a physical separation between fluidic dies 302 and conductive elements 312.

Figure 3B:
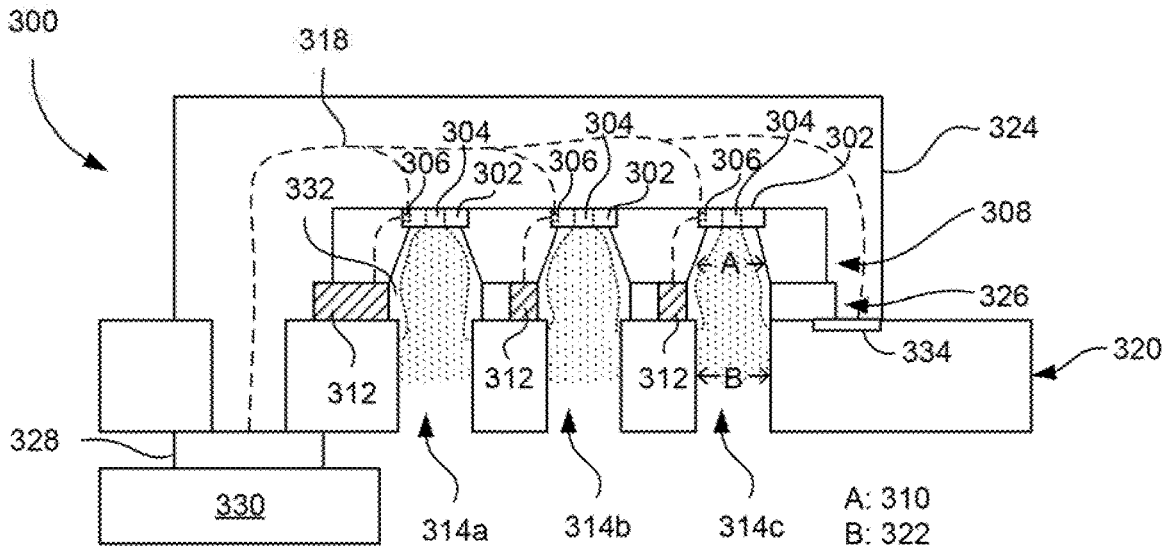
Figure 3C:
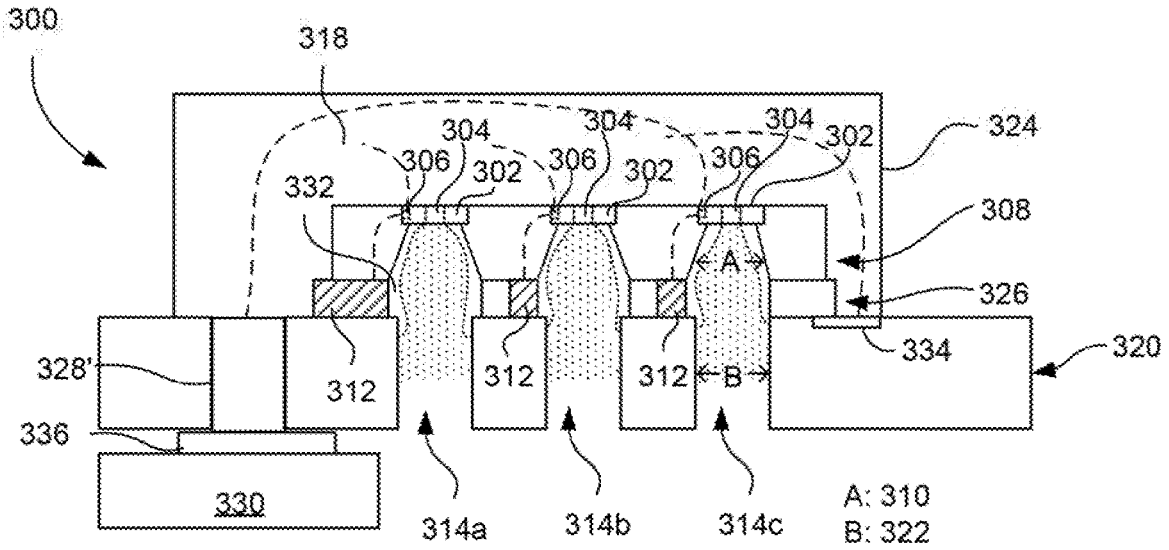

Turning next to FIGS. 3B and 3C, cross sections of additional implementations of fluidic device 300 are illustrated. FIGS. 3B and 3C are similar in many ways to FIG. 3A. And thus, discussion of similar elements will be not be repeated here. In terms of differences, FIG. 3B illustrates an implementation in which substrate 320 also includes a ground 334. As should be appreciated, therefore, more than just fluidic dies (e.g., fluidic dies 302) and conductive elements (e.g., conductive element 312) may be electrically connected to a common grounded. As illustrated in FIG. 3B, then, other implementations may enable formation of an electrochemical cell in response to contact with an electrolyte in fluid paths 314*a*-314*c*.

The implementation of FIG. 3C illustrates a conductive adhesive 336 (e.g., solder) that may be used to connect a ground 328' of substrate 320 to chip package 330.

With the foregoing in mind, it should be apparent that a number of possible implementations may support a system in which a conductive element and a fluidic die are electrically coupled to a common ground to form an electrochemical cell, such as while applying a zero potential.

Figure 4:
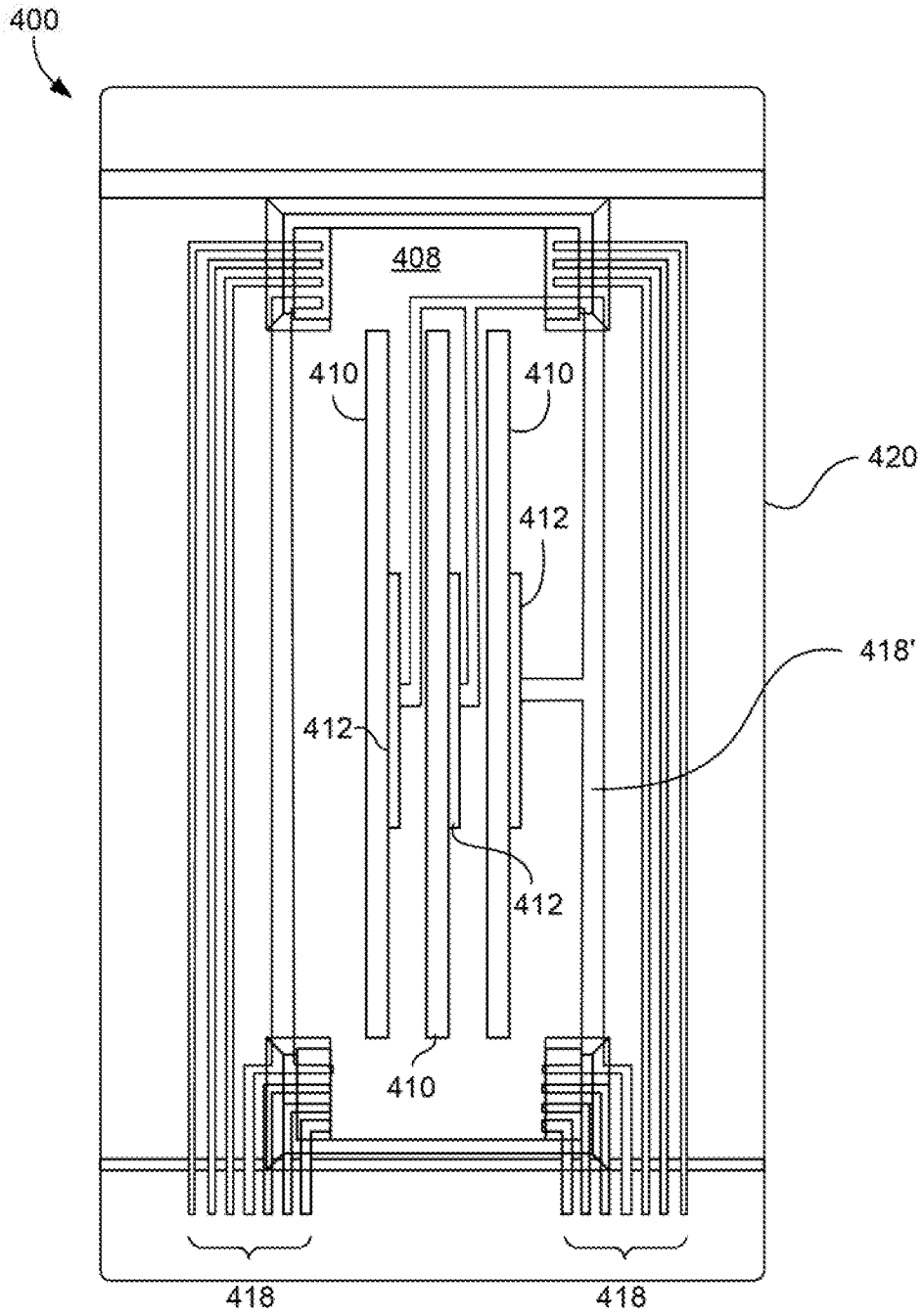
FIG. 4 illustrates an example fluidic device.

FIG. 4 is a top view of an example fluidic device 400 illustrating embedded conductive leads 418. Of note is embedded ground lead 418', which may be used to electrically couple fluidic dies, conductive elements 412, support element 408, and/or substrate 420 to a common ground. Fluidic device 400, support element 408, fluid channels 410 (of support element 408), embedded conductive leads 418, and substrate 420 may be similar to corresponding components discussed above in relation to FIGS. 1A-3C. In one example, embedded conductive leads 418 (including embedded ground lead 418') may be electrically coupled, such as through electrodes on a bottom surface of fluidic device 400, to a chip package and/or other devices (e.g., a printing device).

It should be appreciated that the foregoing components, arranged as disclosed such that fluidic dies and conductive elements are electrically coupled to a common ground to form an electrochemical cell, such as in response to contact with an electrolyte, may be desirable to reduce or eliminate unwanted material etch.

Figure 5:
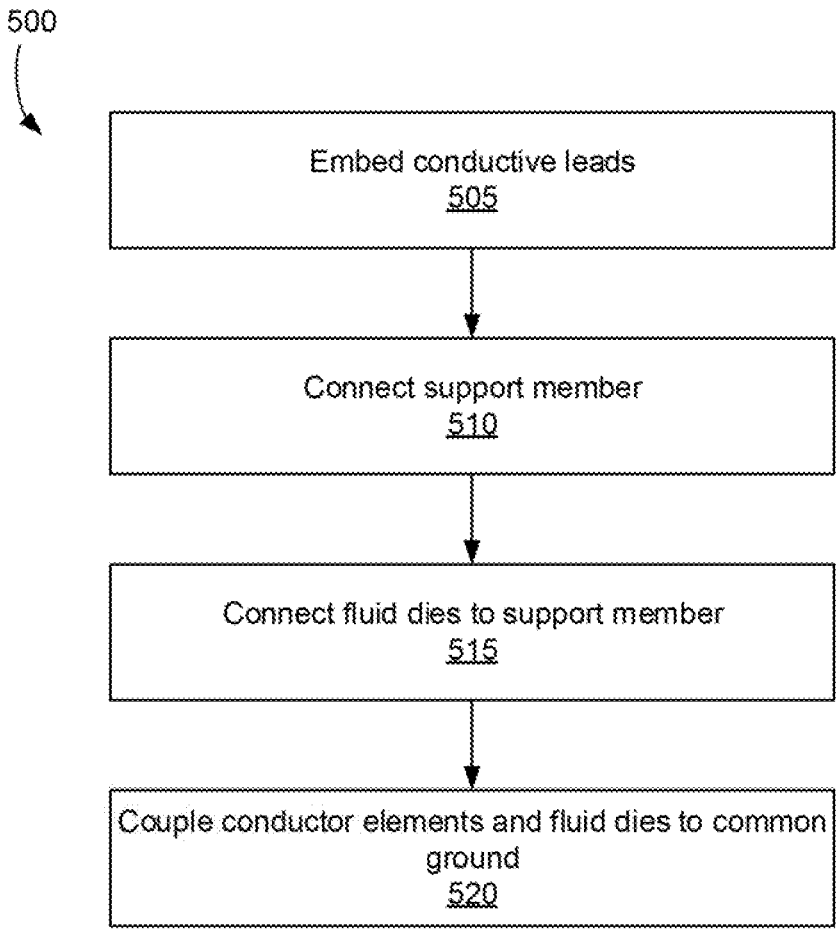
FIG. 5 is a flow diagram for an example method of making a fluidic device.

FIG. 5 illustrates an example method 500 for making a fluidic device (e.g., fluidic device 400 of FIG. 4). The fluidic device may be similar in structure and/or function to fluidic devices 100 of FIG. 1, 200 of FIG. 2, 300 of FIG. 3, and 400 of FIG. 4.

At a block 505, conductive leads may be embedded within a substrate (e.g., substrate 420 of FIG. 4) and/or a support element (e.g., support element 408 of FIG. 4). As noted above the support element may be made of a plastic or an epoxy mold compound, among other things.

At block 510, an epoxy support member (e.g., support element 408 of FIG. 4) may be connected to the substrate. The epoxy support member may have fluid channels and conductive elements (e.g., conductive elements 412 of FIG. 4) arranged within the fluid channels. In one implementation, the conductive elements may be embedded within the support member. In other cases, the conductive elements may be arranged on the outside of, but in contact with, the support member, such as is illustrated in FIGS. 3A-3C.

At block 515, fluidic dies (e.g., fluidic dies 302 of FIGS. 3A-3D) may be connected to the epoxy support member to define fluid paths through the fluid channels of the epoxy support member and through fluid apertures (e.g., fluid apertures 304 in FIGS. 3A-3C).

At block 520, the conductive elements may be electrically coupled to a common ground with the fluidic dies. As such, in response to contact with an electrolyte, an electrochemical cell may be formed to reduce or avoid unwanted material etch.

In the context of the present disclosure, the term "connection," the term "component" and/or similar terms are intended to be physical, but are not necessarily always tangible. Whether or not these terms refer to tangible subject matter, thus, may vary in a particular context of usage. As an example, a tangible connection and/or tangible connection path may be made, such as by a tangible, electrical connection, such as an electrically conductive path comprising metal or other electrical conductor, that is able to conduct electrical current between two tangible components.

In a particular context of usage, such as a particular context in which tangible components are being discussed, therefore, the terms "coupled" and "connected" are used in a manner so that the terms are not synonymous. Similar terms may also be used in a manner in which a similar intention is exhibited. Thus, "connected" is used to indicate that two or more tangible components and/or the like, for example, are tangibly in direct physical contact. Thus, using the previous example, two tangible components that are electrically connected are physically connected via a tangible electrical connection, as previously discussed. However, "coupled," is used to mean that potentially two or more tangible components are tangibly in direct physical contact. Nonetheless, coupled can also be used to mean that two or more tangible components and/or the like are not necessarily tangibly in direct physical contact, but are able to cooperate, liaise, and/or interact, such as, for example, by being "optically coupled." Likewise, the term "coupled" may be understood to mean indirectly connected in an appropriate context.

Unless otherwise indicated, in the context of the present disclosure, the term "or" if used to associate a list, such as A, B, or C, is intended to mean A, B, and C, here used in the inclusive sense, as well as A, B, or C, here used in the exclusive sense. With this understanding, "and" is used in the inclusive sense and intended to mean A, B, and C, whereas "and/or" can be used in an abundance of caution to make clear that all of the foregoing meanings are intended, although such usage is not required.

In the preceding description, various aspects of claimed subject matter have been described. For purposes of explanation, specifics, such as amounts, systems and/or configurations, as examples, were set forth. In other instances, well-known features were omitted and/or simplified so as not to obscure claimed subject matter. While certain features have been illustrated and/or described herein, many modifications, substitutions, changes and/or equivalents will now occur to those skilled in the art. It is, therefore, to be understood that the appended claims are intended to cover all modifications and/or changes as fall within claimed subject matter.

What is claimed is:

1. A fluidic device comprising:

a fluidic die;

a support element coupled to the fluidic die, wherein the fluidic die is secured directly to the support element;

a fluid channel within the support element and defining a fluid path through the support element and a fluid aperture of the fluidic die; and a conductive element arranged in the fluid path, the conductive element electrically coupled to a ground of the fluidic die, and a material and size of the conductive element to engender galvanic effect at an approximately zero potential, wherein the conductive element comprises a metal or metalloid.

2. The fluidic device of claim 1 further comprising a substrate coupled to the support element, the substrate comprising conductive leads embedded therein.

3. The fluidic device of claim 2, wherein the embedded conductive leads comprise a ground lead to enable the electric coupling between the ground of the fluidic die and the conductive element.

4. The fluidic device of claim 3 further comprising a chip package comprising a printed circuit board (PCB), molded interconnect device, or molded lead frame device coupled to the substrate, and comprising a ground connected to the ground lead.

5. The fluidic device of claim 1, wherein the conductive element is arranged to be out of direct physical contact with the fluidic die.

6. A fluidic device comprising:

a fluidic die comprising a fluid aperture;

a support element coupled to the fluidic die and comprising a fluid channel corresponding to the fluid aperture to define a fluid path through the support element and the fluidic die, and embedded conductive leads, wherein the fluidic die is secured directly to the support element; and a conductive element arranged with respect to the fluidic die and the support element such that a surface of the conductive element is arranged in the fluid channel, and further wherein the conductive element is electrically coupled via the embedded conductive leads to a ground of the fluidic die, and wherein the conductive element comprises a metal or metalloid.

7. The fluidic device of claim 6, a ratio of a surface area of the surface of the conductive element arranged in the fluid channel to a surface area of the fluidic die exposed in the fluid path is approximately 1:1 to 3:1.

8. The fluidic device of claim 6, wherein the conductive element comprises Au.

9. The fluidic device of claim 6 further comprising additional fluidic dies comprising additional fluid apertures, the support element comprising additional fluid channels, and wherein the additional fluid apertures and the additional fluid channels define additional fluid paths, the fluidic device further comprising additional conductive elements corresponding to the additional fluid paths.

10. The fluidic device of claim 9, wherein the embedded conductive leads provide an electrical coupling between a ground of the additional fluidic dies and the additional conductive elements.

11. The fluidic device of claim 6, wherein the fluidic die and the conductive element are arranged such that a structural element, an adhesive, a gap, or a combination thereof, provide a physical separation between the fluidic die and the conductive element.

12. The fluidic device of claim 6, wherein the fluidic die and the conductive element are to form an electrochemical cell while in contact with an electrolyte.

13. A method of making a fluidic device, the method comprising:

embedding conductive leads within a substrate;

connecting an epoxy support member to the substrate, the epoxy support member comprising fluid channels, conductive elements arranged within the fluid channels; and connecting fluidic dies to the epoxy support member to define fluid paths through the fluid channels and apertures of the fluidic dies, the conductive elements electrically coupled to a common ground with the fluidic dies, wherein the conductive elements comprise a metal or metalloid, and wherein the fluidic dies are secured directly to the epoxy support element.

14. The method of claim 13, wherein the materials of the fluidic dies and the conductive elements are selected to grow a protective layer on a portion of the fluid paths in response to application of a zero potential.

15. The method of claim 14, wherein the protective layer is to be grown in response to a contact between an electrolyte with the conductive elements and the fluidic dies.

* * * * *